US007731252B1

(12) United States Patent
Stewart

(10) Patent No.: US 7,731,252 B1
(45) Date of Patent: Jun. 8, 2010

(54) DOOR SAFETY DEVICE

(76) Inventor: Rodney D. Stewart, 1801 Highway 99, Suite 1, Ashland, OR (US) 97530

( * ) Notice: Subject to any disclaimer, the term of this patent is extended or adjusted under 35 U.S.C. 154(b) by 374 days.

(21) Appl. No.: 11/266,962

(22) Filed: Nov. 3, 2005

(51) Int. Cl.
*E05C 19/00* (2006.01)

(52) U.S. Cl. ..... 292/259 R; 292/288; 292/DIG. 46

(58) Field of Classification Search ..... 292/339, 292/343, 338, DIG. 46, DIG. 28, 288, 289
See application file for complete search history.

(56) References Cited

U.S. PATENT DOCUMENTS

| | | | | | |
|---|---|---|---|---|---|
| 1,438,209 | A | * | 12/1922 | Attwood | 292/155 |
| 2,058,639 | A | * | 10/1936 | Shoolman et al. | 292/338 |
| 4,272,113 | A | | 6/1981 | Zins | |
| 4,324,514 | A | * | 4/1982 | Craven | 409/179 |
| 4,437,694 | A | | 3/1984 | Lillo | |
| 4,639,023 | A | * | 1/1987 | Boisvert | 292/262 |
| 4,763,607 | A | * | 8/1988 | Tominaga | 119/452 |
| 4,798,407 | A | | 1/1989 | Miller | |
| 4,993,761 | A | | 2/1991 | Paskert | |
| 5,141,272 | A | * | 8/1992 | Veillette | 292/338 |
| 5,234,239 | A | | 8/1993 | Allenbaugh | |
| 5,294,159 | A | * | 3/1994 | Corrigan | 292/258 |
| 5,951,071 | A | | 9/1999 | Elliott | |
| 5,954,901 | A | * | 9/1999 | Henderson | 156/94 |
| 5,971,450 | A | * | 10/1999 | Suarez | 292/289 |
| 2003/0206103 | A1 | * | 11/2003 | Morrone et al. | 340/545.1 |

* cited by examiner

*Primary Examiner*—Gary Estremsky
(74) *Attorney, Agent, or Firm*—Gerald D. Haynes; R. Keith Harrison

(57) ABSTRACT

A door safety device is disclosed. The door safety device includes a lock member, an attachment member carried by the lock member and an attachment device carried by the attachment member. A method of securing a sliding door in a closed position in a sliding door assembly is also disclosed.

1 Claim, 3 Drawing Sheets

DOOR SAFETY DEVICE

FIELD

The present invention relates to devices for securing doors. More particularly, the present invention relates to a door safety device which is suitable for securing a sliding glass door in a closed position.

BACKGROUND

Sliding glass doors are often installed in homes to separate a patio or balcony, for example, from the interior of the home. A conventional sliding glass door has a fixed window pane and a sliding glass door which is slidably mounted in a track. The sliding glass door can be selectively closed by sliding the door to a position adjacent to the fixed window pane and opened by sliding the door to a position in front of the fixed window pane. When in the closed position, the door may be locked using a conventional locking mechanism and additionally secured by inserting a shortened broom stick, for example, between the edge of the door and the facing in which the fixed window pane is mounted. Persons must typically bend over to insert the stick in place in order to secure the door in a closed position or remove the stick in order to facilitate opening of the door. This may be difficult for persons who suffer from back problems or for the elderly, for example.

SUMMARY

The present invention is generally directed to a door safety device. In an illustrative embodiment, the door safety device includes a lock member, an attachment member carried by the lock member and an attachment device carried by the attachment member.

The present invention is further directed to a method of securing a sliding door in a closed position in a sliding door assembly. In an illustrative embodiment, the method includes providing a door safety device comprising a lock member, an attachment member carried by the lock member and an attachment device carried by the attachment member; and inserting the door safety device between the sliding door and the door facing in the sliding door assembly.

BRIEF DESCRIPTION OF THE DRAWINGS

The invention will now be described, by way of example, with reference to the accompanying drawings, in which.

DETAILED DESCRIPTION

Figure 3:
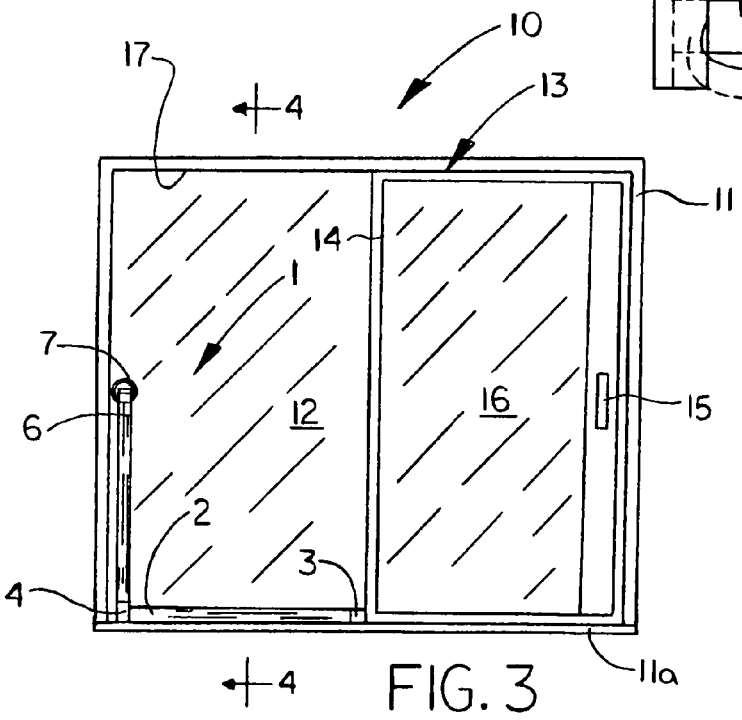
FIG. 3 is a front view of an illustrative sliding glass door assembly, illustrating an illustrative embodiment of a door safety device according to the present invention inserted in a door-securing position in the sliding glass door assembly to secure a sliding glass door in a closed position.

Referring initially to FIGS. 1-6 of the drawings, an illustrative embodiment of a door safety device according to the present invention is generally indicated by reference numeral 1. As shown in FIG. 3 and will be hereinafter described, the door safety device 1 is suitable for securing a sliding glass door 13 in a closed position in a sliding glass door assembly 10. The sliding glass door assembly 10 may be conventional and may include, for example, an opening 17 which is provided in a wall 11 of a home or business, for example. A window pane 12 is typically mounted in one half of the opening 17, and a track 11*a* is provided in the bottom of the opening 17. A sliding glass door 13 includes a door frame 14 which is mounted in the track 11*a*, a door handle 15 which is provided in or on the door frame 14 and a door pane 16 which is provided in the door frame 14. The sliding glass door 13 is capable of being selectively positioned in a closed position, in which the sliding glass door 13 is adjacent to the window pane 12, as shown in FIG. 3, and an open position, in which the sliding glass door 13 is in front of the window pane 12 to permit ingress and egress through the open half 10*a* (FIG. 6) of the sliding glass door assembly 10 adjacent to the window pane 12.

Figure 1:
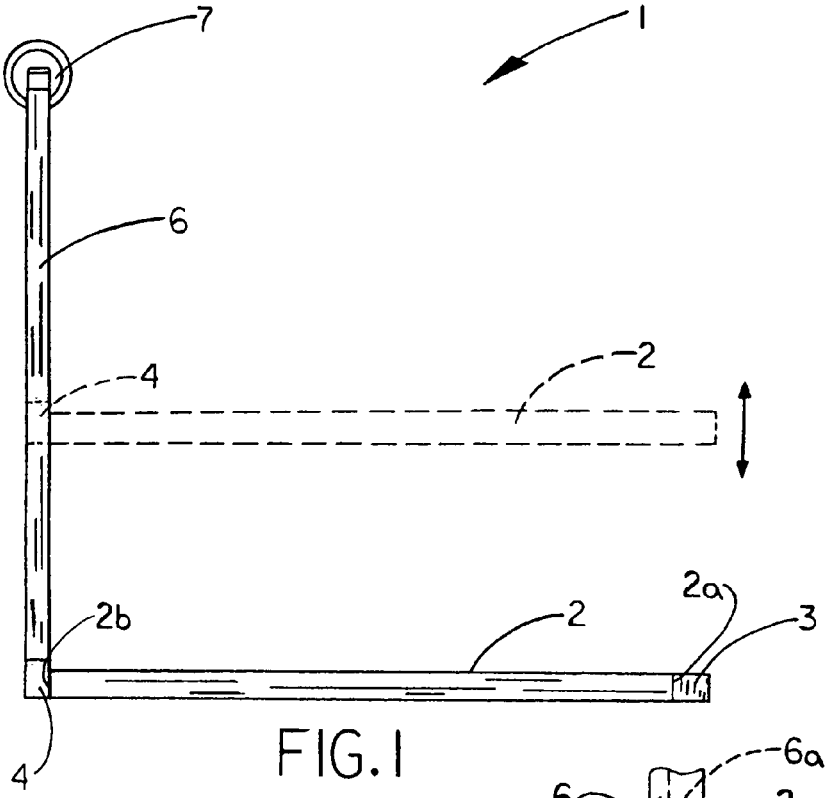
FIG. 1 is a front view of an illustrative embodiment of a door safety device according to the present invention.
Figure 2:
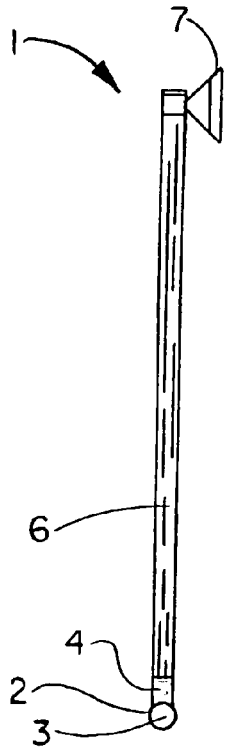
FIG. 2 is a left side view of an illustrative embodiment of a door safety device according to the present invention.
Figure 2A:
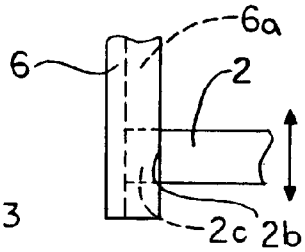
FIG. 2A is a sectional view illustrating an alternative technique for adjustably mounting a lock member on an attachment member element of an illustrative embodiment of a door safety device according to the present invention.

The door safety device 1 includes a lock member 2 which may have a generally elongated configuration and may be metal, wood or durable plastic, for example. A cap 3, which may be rubber or plastic, for example, may be provided on a distal end 2*a* of the lock member 2. The door safety device 1 further includes an attachment member 6 which extends from the lock member 2. The attachment member 6 may have a generally elongated configuration and may be metal, wood or durable plastic, for example. The attachment member 6 may be disposed at a generally perpendicular or 90-degree angle with respect to the lock member 2. A proximal end 2*b* of the lock member 2 may be fixedly or adjustably associated with the attachment member 6. For example, in one embodiment shown in FIGS. 1 and 2, a mount sleeve 4 is provided on the attachment member 6 and the lock member 2 extends from the mount sleeve 4. The mount sleeve 4 slidably engages the attachment member 6 through a friction-fit or other mechanism in such a manner that the mount sleeve 4 can be adjusted to a selected position along the attachment member 6, as indicated by the phantom lines in FIG. 1. In an alternative embodiment, shown in FIG. 2A, a flange 2*c* extends from the proximal end 2*b* of the lock member 2. A slot 6*a* is provided in the attachment member 6. The flange 2*c* is slidably mounted in the slot 6*a* through a friction-fit or other mechanism in such a manner that the lock member 2 can be adjusted to a selected position along the attachment member 6 as the flange 2*c* slides in the slot 6*a*.

An attachment device 7 may be provided on the attachment member 6 of the door safety device 1 to facilitate detachably securing the attachment member 6 to the window pane 12 or other element of the sliding glass door 10 in typical use of the door safety device 1, as shown in FIG. 3 and as will be hereinafter described. The attachment device 7 may be, for example, at least one suction cup. However, it is to be understood that the attachment device 7 may be any suitable alternative device, such as hook-and-loop fasteners, for example, which is capable of detachably securing the attachment member 6 to the window pane 12 or other element of the sliding glass door 10. Furthermore, the attachment device 7 may be any combination of devices which are capable of securing the attachment member 6.

Figure 4:
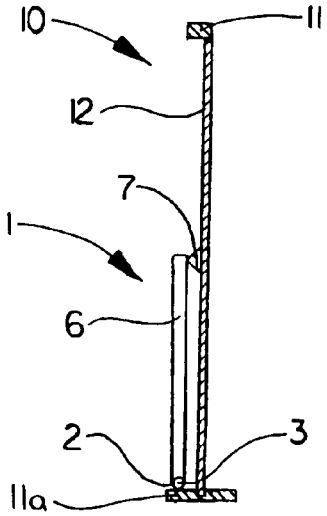
FIG. 4 is a cross-sectional view, taken along section lines 4-4 in FIG. 3, of an illustrative sliding glass door assembly, with a door safety device inserted in a door-securing position in the sliding glass door assembly.
Figure 5:
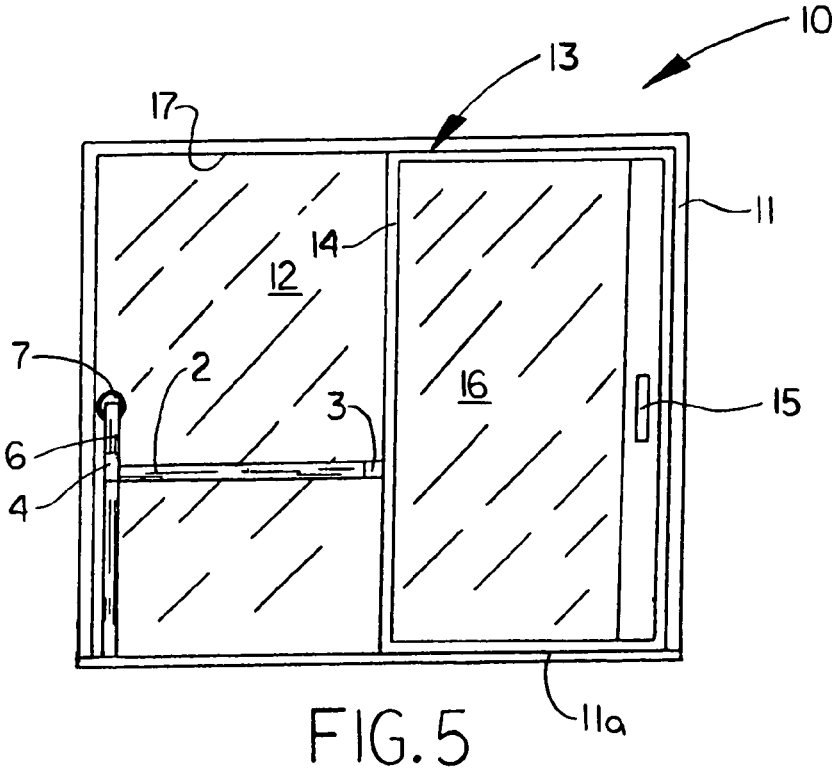
FIG. 5 is a front view of a sliding glass door assembly, with a door safety device according to the present invention inserted in a door-securing position in the sliding glass door assembly, more particularly illustrating a lock member element of the door safety device positioned in an upper position on an attachment member element of the door safety device.
Figure 6:
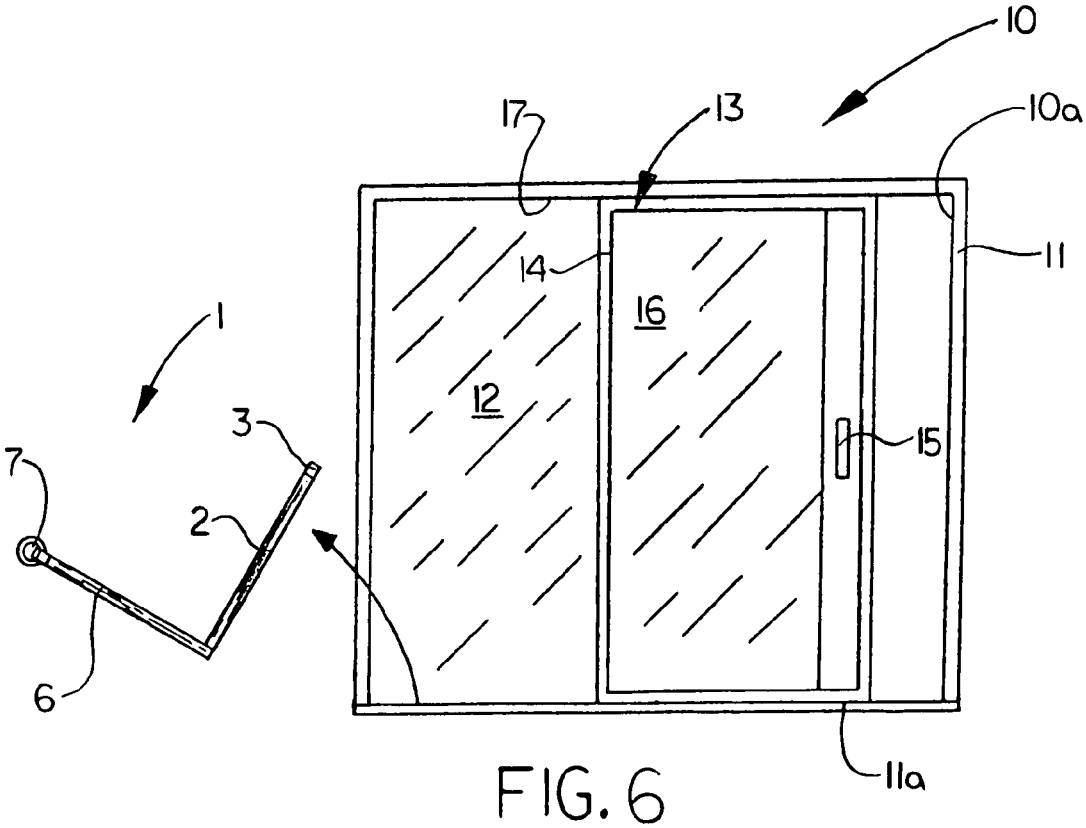
FIG. 6 is a front view of a sliding glass door assembly, with an illustrative embodiment of a door safety device removed from the door-securing position in the sliding glass door assembly to facilitate opening of the sliding glass door.

In typical use, the door safety device 1 secures the sliding glass door 13 in the closed position in the sliding glass door assembly 10. Accordingly, the sliding glass door 13 is initially positioned in the closed position in the sliding glass door assembly 10 shown in FIG. 3. The sliding glass door 13 may be locked in the closed position using a conventional locking mechanism (not shown). The door safety device 1 is then inserted between the door frame 14 of the sliding glass door 13 and the door facing inside the opening 17 in which the window pane 12 is mounted, as further shown in FIG. 3. Prior to insertion of the safety device 1, the lock member 2 may be adjusted to a selected position along the attachment member 6, as shown in FIG. 5. Alternatively, the lock member 2 may remain positioned at the lower end of the attachment member 6, as shown in FIG. 3. The cap 3 on the lock member 2 typically engages the door frame 14 of the sliding glass door 13, and the attachment member 6 engages the door facing inside the opening 17. The attachment device 7 is attached to the window pane 12 of the sliding glass door assembly 10, as illustrated in FIG. 4, to secure the door safety device 1 in an upright position. Accordingly, the lock member 2 with the attachment member 6 of the door safety device 1 span the gap between the door frame 14 and the door facing inside the opening 17 to prevent sliding of the sliding glass door 13 to the open position in the track 11*a*. When it is desired to slide the sliding glass door 13 to the open position, the attachment device 7 is detached from the window pane 12 to facilitate subsequent removal of the door safety device 1 from the sliding glass door assembly 10, as shown in FIG. 6. It will be appreciated by those skilled in the art that a user (not shown) may insert the door safety device 1 in the sliding glass door assembly 10 and remove the door safety device 1 from the sliding glass door assembly 10 by manually grasping the attachment member 6, thereby eliminating the need for the user to bend over during the insertion and removal steps.

Figure 7:
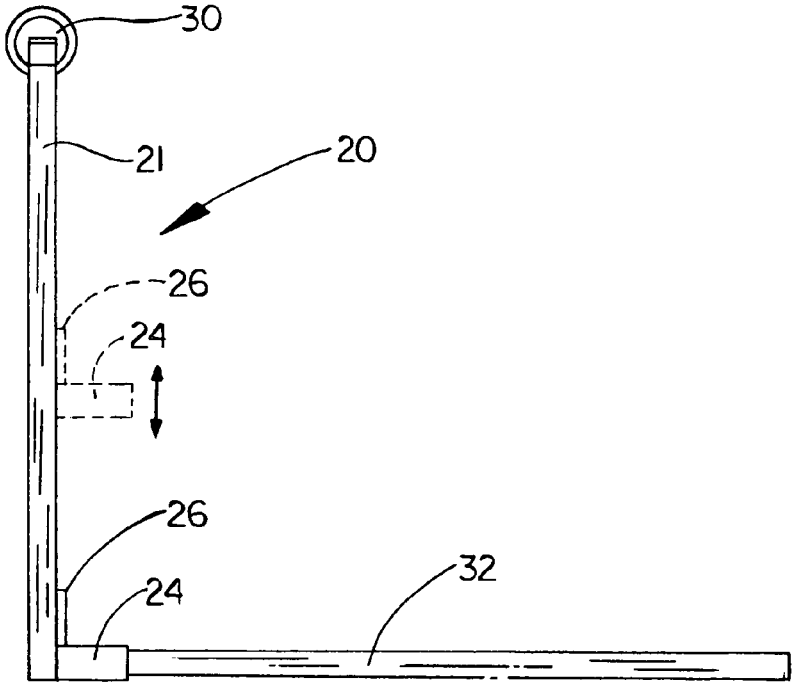
FIG. 7 is a front view of an alternative illustrative embodiment of a door safety device according to the present invention.
Figure 8:
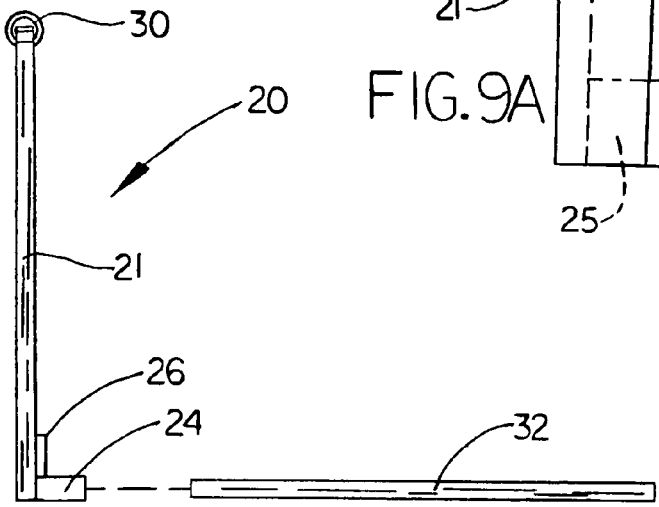
FIG. 8 is a front view of an alternative illustrative embodiment of a door safety device according to the present invention, with a lock member element detached from a clamp element of the door safety device.
Figure 9A:
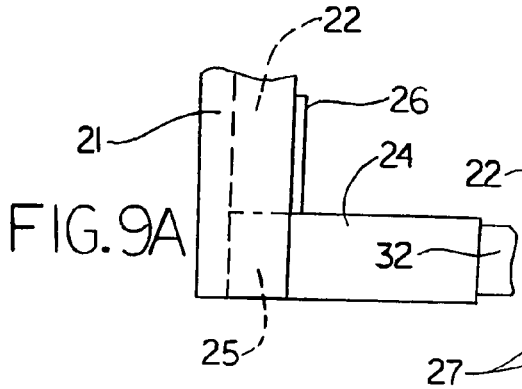
FIG. 9A is a front view of a clamp element of an illustrative embodiment of a door safety device according to the present invention.
Figure 9:
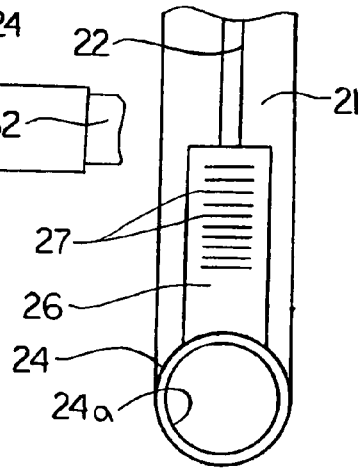
FIG. 9 is a left side view of a clamp element of an illustrative embodiment of a door safety device according to the present invention, with the clamp element slidably and adjustably mounted in a clamp slot provided in the attachment member element of the door safety device.

Referring next to FIGS. 7-9 of the drawings, an alternative illustrative embodiment of a door safety device according to the present invention is generally indicated by reference numeral 20. The door safety device 20 includes an attachment member 21 which may have a generally elongated configuration and may be metal, wood or plastic, for example. An attachment device 30, which may be a suction cup or hook-and-loop fasteners, for example, or any combination of attachment devices, may be provided on the attachment member 20. A clamp 24 is provided on the attachment member 21 and, as shown in FIG. 9, includes a clamp interior 24*a* which is adapted to receive a lock member 32. The lock member 32 may be a shortened broom stick or the like, for example.

The clamp 24 may be adjustably mounted on the attachment member 21, as shown in phantom in FIG. 7. For example, a clamp slot 22 may be provided in the attachment member 21. As shown in FIG. 9A, a clamp flange 25 extends from the clamp 24 and is inserted in the clamp slot 22. The clamp flange 25 may be fitted in the clamp slot 22 through a friction fit or other technique. A clamp tab 26 may be provided on the clamp 24 to facilitate finger adjustment of the clamp 24 along the attachment member 21. As shown in FIG. 9, finger ridges 27 may be provided on the clamp tab 26. It is to be understood that the clamp 24 may be adjustably mounted along the attachment member 21 using any suitable alternative technique which is known by those skilled in the art.

In typical use, the attachment device 30 secures a sliding glass door (not shown) in a closed position in a sliding glass door assembly typically in the same manner as was heretofore described with respect to securing of the sliding glass door 13 in the closed position using the door safety device 1 of FIGS. 1-6. Prior to use of the attachment device 30, however, the lock member 32, which may be a shortened broomstick or the like, for example, is attached to the clamp 24, typically by inserting the lock member 32 into the clamp interior 24*a* of the clamp 24. Therefore, when positioned in place in a sliding glass door assembly, the door safety device 20 is effective to prevent unauthorized opening of the sliding glass door in the sliding glass door assembly.

While the preferred embodiments of the invention have been described above, it will be recognized and understood that various modifications can be made in the invention and the appended claims are intended to cover all such modifications which may fall within the spirit and scope of the invention.

What is claimed is:

1. A method of securing a sliding door in a closed position in a sliding door assembly having a door facing, comprising:

providing a door safety device comprising an elongated attachment member having a longitudinal axis, a uniformly axial straight lock member carried by the attachment member and adjustable along the longitudinal axis of the attachment member and an attachment device, comprising a suction cup, carried by the attachment member, the lock member disposed in substantially fixed perpendicular relationship with respect to the attachment member and the lock member adjustable toward and away from the attachment device;

wherein a plane defined by the suction cup of the attachment device is oriented generally parallel to a plane defined by the lock member and the attachment member; and inserting the door safety device between the sliding door and the door facing in the sliding door assembly.

* * * * *